United States Patent [19]

Benarrouch

[11] Patent Number: 4,609,301

[45] Date of Patent: Sep. 2, 1986

[54] HOUSEHOLD-TYPE DISHWASHING UTENSIL

[76] Inventor: Jacques Benarrouch, 1, rue de Bruxelles, 69100 Villeurbanne, France

[21] Appl. No.: 707,942

[22] Filed: Feb. 28, 1985

[30] Foreign Application Priority Data

Feb. 29, 1984 [FR] France ..... 84 03343

[51] Int. Cl.[4] ..... B43M 11/06; B05C 21/00

[52] U.S. Cl. ..... 401/196; 401/207; 15/244 R; 15/210 R

[58] Field of Search ..... 15/244 R, 210 R; 401/203–207, 183, 196, 244

[56] References Cited

U.S. PATENT DOCUMENTS

| | | | |
|---|---|---|---|
| 2,225,101 | 5/1939 | Conk et al. | 401/203 |
| 2,602,948 | 7/1952 | Kautenberg | 15/244 R |
| 2,941,225 | 6/1960 | Paul | 15/244 R |
| 2,998,614 | 9/1961 | Winch | 40/210 R |
| 3,058,139 | 10/1962 | Dryden | 15/244 R |
| 3,098,253 | 7/1963 | Harrison | 15/236 R |
| 3,847,151 | 11/1974 | D'Alessandro et al. | 401/244 |
| 4,498,796 | 2/1985 | Gorden et al. | 401/196 |

FOREIGN PATENT DOCUMENTS

| | | | |
|---|---|---|---|
| 630997 | 7/1963 | Belgium | 401/203 |
| 95467 | 5/1963 | Denmark | 401/203 |
| 844808 | 7/1952 | Fed. Rep. of Germany | 401/183 |
| 8208044 | 5/1982 | France | 401/203 |
| 6915843 | 10/1969 | Netherlands | 401/203 |

*Primary Examiner*—Richard J. Apley
*Assistant Examiner*—Alfedo Acoff
*Attorney, Agent, or Firm*—Michael J. Striker

[57] ABSTRACT

A washing and scrubbing utensil has a hollow elongated handle having a back longitudinal end provided with a cap and an opposite front longitudinal end formed with a central longitudinally forwardly projecting feed tube communicating with the interior of the handle and with two longitudinally forwardly projecting holding spikes each having opposite edges formed with sawteeth. A sponge is fitted to the front end with the spikes and feed tube imbedded in the sponge and the sawteeth of the spikes poking into the sponge. The spikes are generally flat and lie generally in a common plane with the teeth of each spike projecting oppositely in the plane, the sponge being formed with respective slits receiving the spikes and extending generally perpendicular to the plane thereof. The sponge is formed with a further such slit between the slits of the spikes and receiving the feed tube. This slit is of substantially the same longitudinal length as the feed tube and is of a width equal generally to half of the circumference of the feed tube.

11 Claims, 5 Drawing Figures

HOUSEHOLD-TYPE DISHWASHING UTENSIL

FIELD OF THE INVENTION

The present invention relates to a utensil for washing and scrubbing dishes and the like. More particularly this invention concerns a sponge-type device that is filled with detergent.

BACKGROUND OF THE INVENTION

A standard utensil that serves to wash dishes, pots and pans, windows, cars, and the like has a hollow handle adapted to hold a supply of detergent and carrying at a front end a brush or sponge. A feed tube that communicates with the interior of the handle extends into the brush so that the detergent can be dosed directly thereto. Thus the user can add detergent while using the device for effective cleaning and scrubbing action.

In U.S. Pat. No. 2,225,101 of Conk such a utensil is shown which has a hollow handle whose one longitudinal end extends into a sponge. The sponge is held between a flange on the handle and a washer spaced forward therefrom and connected to this flange by bolts. Thus the sponge, which here is of fairly solid material, is held solidly so long as it does not soften too much. In this case the complicated connection must be tightened. Such an arrangement is therefore expensive to manufacture and requires some adjustment in use.

In U.S. Pat. No. 2,998,614 of Winch the handle fits within a cleaning swab shaped like a pocket. Lateral barbs on the side of the front handle end are intended to retain the pocket on the swab. Nonetheless the swab can slip off the handle and only a relatively thin swab can be used.

The arrangement of Belgian Pat. No. 630,997 filed Apr. 12, 1963 by J. Boel has a sponge surrounding the perforated front end of the handle and having a collar that extends back around the handle and that is clamped thereto by a ring. This style of connection is fairly fragile, as the collar of the sponge can tear off relatively easily.

French Pat. No. 8,208,044 filed May 10, 1982 M. S. Puebla describes another such utensil where the sponge is glued to a rigid element that can be snap-fitted onto the open front end of the handle. The disadvantage of this arrangement is that the support element is applied over a major face of the sponge so that only one face of the sponge is available for use in washing. In addition there is leakage at the joint between the carrying plate and the handle, and the glue that holds the sponge to the carrying element rapidly breaks down and the sponge falls off.

OBJECTS OF THE INVENTION

It is therefore an object of the present invention to provide an improved washing and scrubbing utensil.

Another object is the provision of such a washing and scrubbing utensil which overcomes the above-given disadvantages, that is which is solidly connected together so that the sponge will not fall off, that allows both faces of the sponge to be used, and that is relatively simple and inexpensive to manufacture.

SUMMARY OF THE INVENTION

A washing and scrubbing utensil according to the invention has a hollow elongated handle having a back longitudinal end provided with a cap and an opposite front longitudinal end formed with a central longitudinally forwardly projecting feed tube communicating with the interior of the handle and with two longitudinally forwardly projecting holding spikes each having opposite edges formed with sawteeth. A sponge is fitted to the front end with the spikes and feed tube imbedded in the sponge and the sawteeth of the spikes poking into the sponge. The spikes are generally flat and lie generally in a common plane with the teeth of each spike projecting oppositely in the plane, the sponge being formed with respective slits receiving the spikes and extending generally perpendicular to the plane thereof.

This type of attachment is extremely robust, yet very simple and inexpensive to manufacture. The sawteeth engage solidly in the heart of the sponge at a multiplicity of locations so that the spikes are solidly lodged in the sponge. There is no adhesive to fail and release, and both sides of the sponge can be used.

According to another feature of this invention the sponge is formed with a further such slit between the slits of the spikes and receiving the feed tube. This slit is of substantially the same longitudinal length as the feed tube and is of a width equal generally to half of the circumference of the feed tube.

The spike slits according to this invention are of substantially the same longitudinal length as the spikes and of a width measured transverse to the plane that is substantially equal to the width of the spikes in the plane. In addition the feed tube has a longitudinally forward tip generally centered in the sponge.

In addition the hollow handle is shaped and curved such that, when rested on a horizontal surface and filled with a predetermined quantity of wash liquid, the surface of the liquid is below the highest point of the feed tube. Thus when set down the utensil will not leak.

The spikes in accordance with this invention are formed with longitudinally extending and forwardly tapered stiffening ribs. The spikes, feed tube, and handle are unitary and of a synthetic resin, although it is also possible to make the spikes separate and screw them into the handle.

DESCRIPTION OF THE DRAWING

The above and other features and advantages will become more readily apparent from the following, reference being made to the accompanying drawing in which.

SPECIFIC DESCRIPTION

Figure 1:
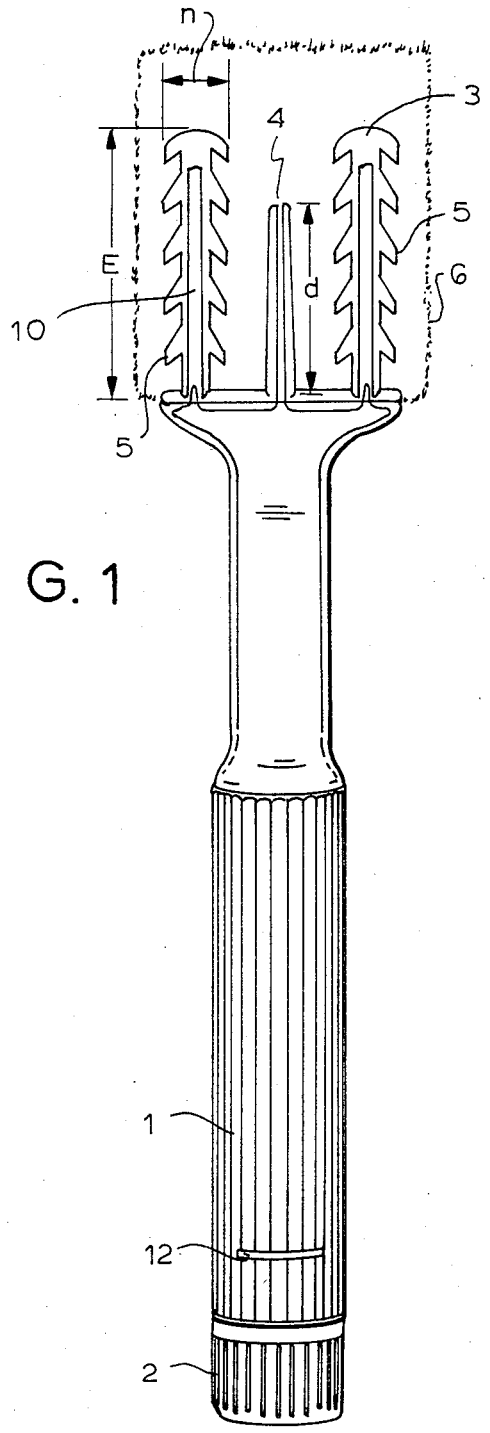
FIG. 1 is front view of the scrubber according to this invention with the sponge shown only in outline.
Figure 2:
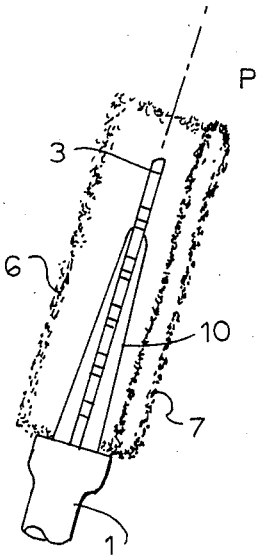
FIG. 2 is a side view like FIG. 1 of the head of the scrubber.
Figure 3:
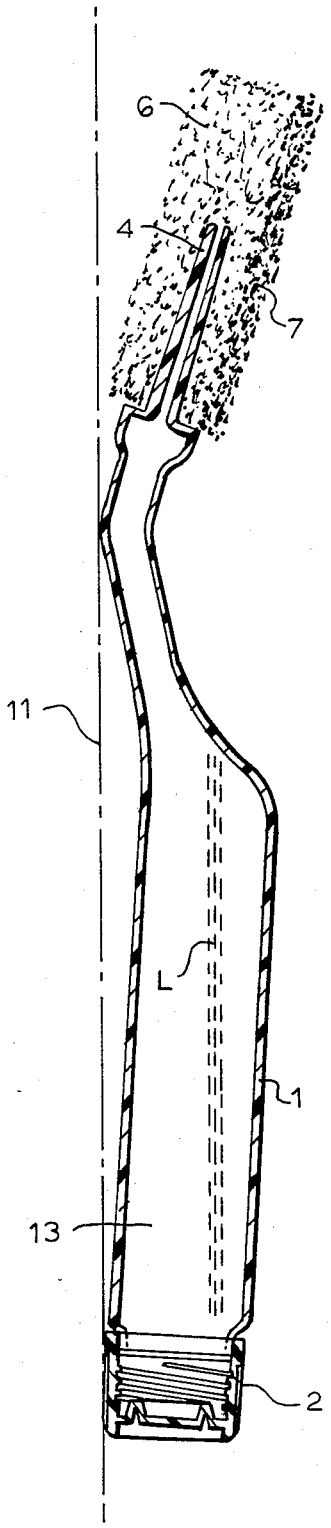
FIG. 3 is an axial section through the scrubber in accordance with this invention.

As seen in FIGS. 1 and 2 the utensil according to this invention basically comprises an elongated handle 1 having a rear end closed by a threaded cap 2 and a front end formed with a pair of spikes 3 and a feed tube 4 that carry a parallelepipedal sponge 6 provided on one face with a scratchy metal-filament layer 7 (FIG. 3).

The spikes 3 are identical and parallel to each other. They define a plane P and are formed in this plane P with opposite rows, of backwardly hooked barbs or sawteeth 5. These sawteeth 5 are tapered toward their ends so they hook into and springingly engage the sponge 6.

Figure 4:
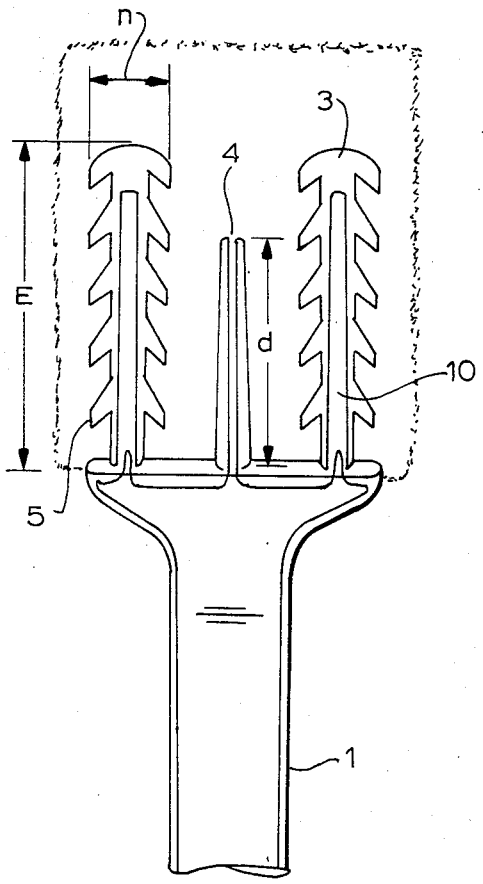
FIG. 4 is a large-scale view of a detail of FIG. 1.
Figure 5:
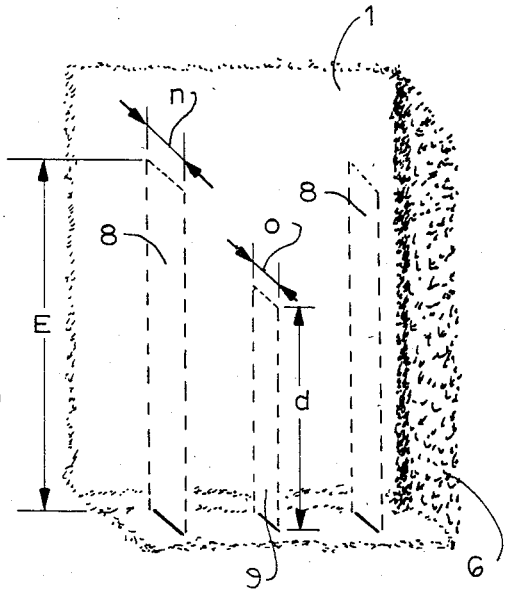
FIG. 5 is a perspective view of the sponge for the scrubber of the invention.

As better shown in FIGS. 4 and 5 the sponge 6 is formed with two rectangular slits 8 of the same longitudinal length E and width n as the spikes 10, but extending in a plane perpendicular thereto. Thus the teeth 5 will bite into the sides of these slits 8 and will positively lodge therein. In addition the spikes 3 are formed with reinforcing ribs 10 that extend perpendicular to the plane P and that taper away from the handle. At their base these ribs 10 give the spikes 3 a width perpendicular to the plane P equal to the slit width n, so that the ribs 10 center these spikes 3 during fitting-together of the utensil.

Between the slits 8 the sponge 6 is formed with another such slit 9 parallel thereto but of a length d and width o that respectively are equal to the length of the feed tube 4 and half of the circumference thereof. Thus this tube 4 will fit snugly in this slit 9, so that its tip will be centered in the sponge 6.

Normally according to this invention the sponge is somewhat longer than the length E and about 1.5 times the width n. It is of a width generally equal to the diameter of a standard footed wine glass and the entire device has a length about equal to the depth of a standard tapered water glass so that the width n is equal to about one quarter the thickness of the sponge 6. For best hold the sponge thickness, measured perpendicular to the plane P, is equal to twice the dimension n, and the length d is equal to about two-thirds the length E. As a rule there should be at least 2 mm of sponge between the slits 8 and the inside surface of the scratchy layer 7.

The handle is shaped such that when laid on a horizontal surface indicated at 11 in FIG. 3 the liquid body 13 contained in it will have a surface L that will lie below the tip of the tube 4. Thus when laid down the utensil will not leak. To prevent overfilling of the utensil a mark 12 is provided on the handle 1, so that the user will know when to stop filling to avoid leakage.

The scratchy layer 7 of the sponge 6 is provided as illustrated on the rear sponge face when the utensil is mainly intended for use in washing. When scrubbing is the main function, the arrangement is constructed in reverse, and in fact the device can be marketed in pieces so the user can decide how to orient it.

Thus the arrangement according to this invention is very simple and inexpensive to manufacture. The sponge is solidly held on the handle and can be counted on to stay put for its full service life.

I claim:

1. A washing and scrubbing utensil comprising:

a hollow elongated handle having a back longitudinal end, an opposite front longitudinal end and an interior;

a cap on said back longitudinal end;

two longitudinally forwardly projecting holding spikes on said front longitudinal end and each having opposite edges formed with sawteeth;

a central longitudinally forwardly projecting feed tube also on said front longitudinal end and communicating with said interior of said handle; and a sponge fitted to said front end with said holding spikes and feed tube imbedded in said sponge and said sawteeth of said holding spikes poking into said sponge, said spikes, feed tube and handle being unitary and together forming a one-piece element.

2. The washing and scrubbing utensil defined in claim 1 wherein the spikes are generally flat and lie generally in a common plane with the teeth of each spike projecting oppositely in the plane, the sponge being formed with respective slits receiving the spikes and extending generally perpendicular to the plane thereof.

3. The washing and scrubbing utensil defined in claim 2 wherein the sponge is formed with a further such slit between the slits of the spikes and receiving the feed tube.

4. The washing and scrubbing utensil defined in claim 3 wherein the further slit is of substantially the same longitudinal length as the feed tube and is of a width equal generally to half of the circumference of the feed tube.

5. The washing and scrubbing utensil defined in claim 2 wherein the spike slits are of substantially the same longitudinal length as the spikes and of a width measured transverse to the plane that is substantially equal to the width of the spikes in the plane.

6. The washing and scrubbing utensil defined in claim 1 wherein feed tube has a longitudinally forward tip generally centered in the sponge.

7. The washing and scrubbing utensil defined in claim 1 wherein the spikes are formed with longitudinally extending and forwardly tapered stiffening ribs.

8. The washing and scrubbing utensil defined in claim 1 wherein said one-piece element including said spikes, feed tube, and handle is of a synthetic resin.

9. The washing and scrubbing utensil defined in claim 1 wherein the sponge has one face provided with an abrasive overlay.

10. The washing and scrubbing utensil defined in claim 3 wherein the utensil is composed of two structures, said sponge with slits being the first structure and said unitary spikes, feed tube and handle being the second structure such that said first structure is mountable on second structure by fitting the former onto the latter with insertion of said spikes and feed tube into said slits.

11. A washing and scrubbing utensil comprising:

a hollow elongated handle having a back longitudinal end, an opposite front longitudinal end and an interior;

a cap on said back longitudinal end;

two longitudinally forwardly projecting holding spikes on said front longitudinal end and each having opposite edges formed with sawteeth;

a central longitudinally forwardly projecting feed tube also on said front longitudinal end and communicating with said interior of said handle; and a sponge fitted to said front end with said holding spikes and feed tube imbedded in said sponge and said sawteeth of said holding spikes poking into said sponge;

said feed tube extending so that when said hollow handle is in a position resting on a horizontal surface and filled with a predetermined quantity of wash liquid, the liquid assumes, within said hollow handle, a horizontal upper surface which is below a highest point of said feed tube in said position, so as to prevent spilling of the wash liquid out of said feed tube.

* * * * *